United States Patent [19]

Fast

[11] Patent Number: 4,646,454

[45] Date of Patent: Mar. 3, 1987

[54] PRODUCT IDENTIFICATION TAG WITH ADAPTABLE MOUNTING PORTION

[76] Inventor: Jacob Fast, 7561 NW. 9th St., Plantation, Fla. 33317

[21] Appl. No.: 792,604

[22] Filed: Oct. 29, 1985

[51] Int. Cl.[4] ..... G09F 1/00

[52] U.S. Cl. ..... 40/124.1; 40/19.5; 40/584; 40/324; 211/54.1

[58] Field of Search ..... 40/19.5, 20 R, 10 R, 40/124.1, 584, 308; 211/54.1

[56] References Cited

U.S. PATENT DOCUMENTS

| | | | |
|---|---|---|---|
| 3,469,813 | 9/1969 | Rizzi | 40/324 |
| 3,539,204 | 11/1970 | Keller | 40/308 |
| 4,292,749 | 10/1981 | Thomas | 40/308 |
| 4,405,051 | 9/1983 | Thalenfeld | 40/19.5 |
| 4,463,510 | 8/1984 | Windish | 40/19.5 |
| 4,531,313 | 7/1985 | Fast | 40/19.5 |

*Primary Examiner*—Gene Mancene

*Assistant Examiner*—Wenceslao J. Contreras

*Attorney, Agent, or Firm*—Holman & Stern

[57] ABSTRACT

A product information and identification tag for use in combination with an elongate product-suspension hook extending from a transverse rod at the back of the hook has a mounting portion particularly adapted to fit on the hook/rod assembly at the junction of the rod and hook, and an elongate intermediate portion for extending over the hook to display product information at the front of the hook. The mounting portion has a central section which can bend at right angles to the intermediate portion and tabs on opposite sides of the central section which can fold backwards or forwards with respect to the central section. The central section has a cut-out which receives the hook, and the tabs have hook formations which can resiliently grip the rod either from the front or from behind depending on which way the tabs are folded.

8 Claims, 5 Drawing Figures

PRODUCT IDENTIFICATION TAG WITH ADAPTABLE MOUNTING PORTION

BACKGROUND OF THE INVENTION

This invention relates to product identification and information tags for merchandise suspended from elongate horizontally oriented support hooks and the like. More particularly, the invention relates to such tags which may be readily attached to and removed from the support hooks without being subject to inadvertent removal, and which display product information forwardly of merchandise supported on a hook.

My U.S. Pat. No. 4,525,944 issued July 2, 1985 discloses, inter alia, elongate product information and identification tags made of plastic sheet which display the product information forwardly of items suspended from horizontal hooks which may extend, for example, from an apertured support board or the like. The tags include a mounting portion for attachment to and removal from the hook at a location adjacent the board, an intermediate portion extending forwardly from the mounting portion along the length of the hook and the merchandise suspended therefrom, and a display portion integrally formed at the distal end of the intermediate portion and which is bent downwardly in front of the hook for the display of required product identification and/or information data. Further, the tags have an aperture adjacent the distal end of the intermediate portion for an end portion of the hook to project upwardly through, thereby providing lateral stabilization of the tag. When a product is removed from the hook over the front end, the tag flexes upwardly to free the end of the hook, and the tag drops back over the end of the hook after the product has been removed.

Further, my copending patent application Ser. No. 719,116 filed Apr. 2, 1985 discloses a similar product identification tag which has a removable and replaceable display portion at the forward end enabling the product labelling readily to be changed, if required.

The disclosures of both my patent and my copending application are expressly incorporated herein by reference.

The tags as disclosed in both the patent and in the pending application are provided with mounting portions particularly adapted for use with horizontally oriented elongate support hooks, generally formed of metal rods, which fit into an apertured board. However, frequently in merchandising displays, the support hooks may form a part of an integrated self-supporting free-standing display unit, with each hook extending, for example, from a transverse metal rod to which the back of the hook may be welded. It is an object of the present invention to provide a merchandise information and display tag structure of the general type discussed above, but which has a mounting portion particularly adapted for fitting onto a hook which is permanently fixed at the back of the hook to a transverse rod of a free-standing display unit or the like.

SUMMARY OF THE INVENTION

The invention provides a product information and identification tag element formed of flexible sheet material, such as stiffish sheet plastic, the tag element being particularly adapted for use in combination with an assembly comprising an elongate product support hook extending substantially horizontally from a transverse rod at the back of the hook for displaying product information at the front of the hook, the tag element including a mounting portion for attachment to the assembly at a rod-hook junction, and an intermediate portion adapted to extend from the mounting portion forwardly over the hook to a forward end of the hook, wherein the mounting portion is attached to the intermediate portion by a transverse bend line, the mounting portion including a central section and foldable tabs on opposite sides of the central section which, when the mounting portion is folded about the bend line in either direction to a position substantially perpendicular to the intermediate portion, can themselves each be folded either forwardly or rearwardly, each tab defining a hook formation adjacent its junction with the central section for resiliently gripping the transverse rod when the tabs are folded as aforesaid, and the central section having a hole for receipt of the support hook.

With the above arrangement, a tag may be mounted on a support hook from the front by folding down the mounting portion, positioning the central hole thereof over the front of the hook, sliding the mounting portion to the back of the hook, and resiliently engaging the tab hook formations with the transverse rod either from the front or behind dependent on which the mounting portion has been folded with respect to the intermediate portion. Preferably, the mounting portion is folded in the direction whereby when attached from the front of the support hook, the central section engages the front of the transverse rod and the tab hooks engage the rod from behind. This provides more positive retention of the tag on the rod/support hook assembly.

It is also possible for the tag to be mounted on the support hook from the back with the central section of the mounting portion engaging against the back of the rod and the tab hooks engaging the rod from the front.

The intermediate portion of the tag may be provided with an elongate slit at its forward end for the front of the support hook to project upwardly through so as to laterally stabilize the tab as disclosed in the aforesaid patent, and the forward end of the intermediate portion may be provided with an integral fold-down display portion or with an attachment means for a detachable display portion.

Additional features and advantages of the invention will become apparent from the ensuing description and claims read in conjunction with the attached drawings.

DESCRIPTION OF PREFERRED EMBODIMENT

Figure 1:
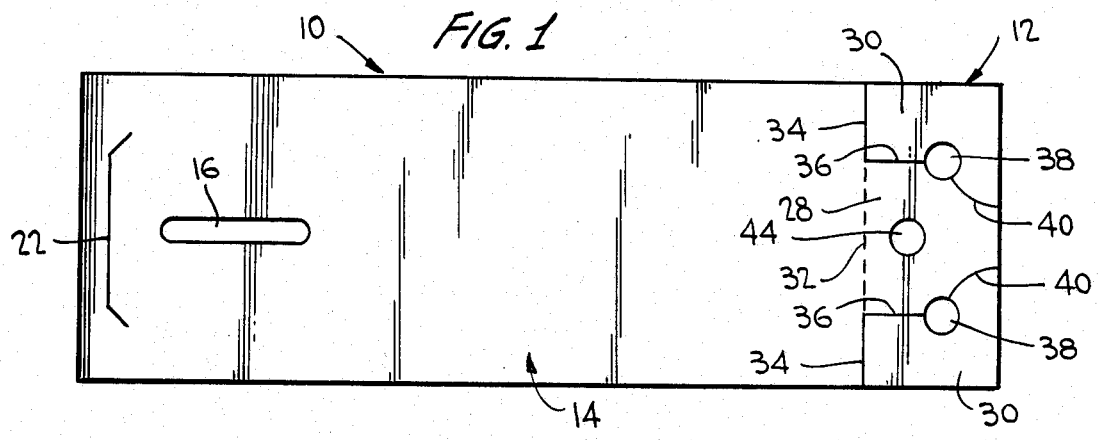
FIG. 1 is a plan view of a product information and identification tag element in accordance with the invention.

An elongate product information and identification tag element 10, FIG. 1, may be die cut from suitable plastic sheet of a type well known for use in such tag elements, the element 10 being shaped and formed, as will be described, to define a mounting portion 12 and an elongate intermediate portion 14 extending from the mounting portion. The intermediate portion has a longitudinal slot 16 near its forward end for the front portion 18 of a product suspension hook 20 (FIGS. 2 and 3) to project upwardly through, as fully described in my aforementioned patent. A transverse slit 22 is also formed at the forward end of the intermediate portion for the releasable receipt of a separate display element 24 which carries product labelling or the like as disclosed in the aforementioned patent application. It is within the scope of the present invention, however, for tag element 10 to have an integrally formed display portion (not shown) at the forward end of intermediate portion 14 in place of slit 22 and element 24.

Mounting portion 12 of the tag element is specifically adapted and formed for using the tag in connection with hook 20, which is of the type that is secured, generally by welding, at its back end to a transverse metal rod 26 which may, for example, form part of a free-standing product display stand or the like provided with a series of the hooks. To this end, mounting portion 12 is formed with a central section 28, and outer folding tabs 30. The central section is joined to the back of intermediate portion 14 by a scored central bend line 32 about which it can be folded, and the bend line merges into transverse die cut or like slits 34 extending to the edges of the tag element and which form edges of the respective tabs 30. Mounting portion 12 further is provided with fold lines 36 which define longitudinal junctions between central section 28 and tabs 30, the fold lines leading to respective die-cut or like circular cut-outs 38 substantially of like diameter to the diameter of rod 26. Arcuate die-cut or like slits 40 extend from the respective cut-outs 38 to the free transverse edge 42 of the tag element. A central circular cut-out 44 is provided in central section 28.

Figure 2:
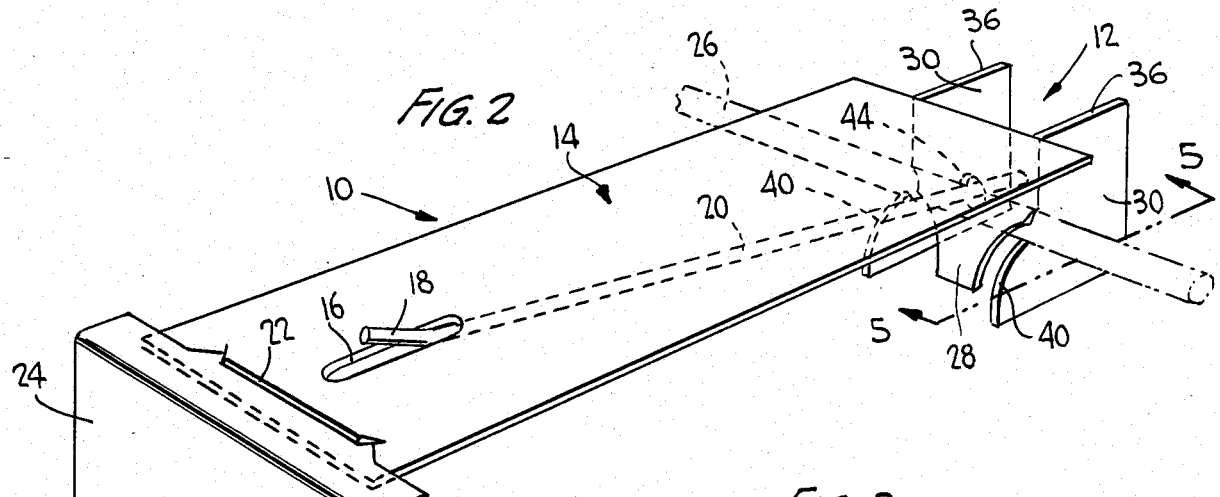
FIG. 2 is a perspective view of a tag formed from the element shown in FIG. 1, the tag being shown in combination with an elongate product support hook assembly in a first manner of attachment of the tag.
Figure 5:
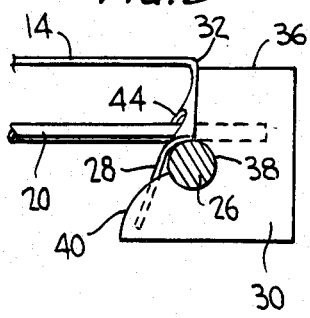
FIG. 5 is a sectional view on line 5—5 of FIG. 2.

In use, central section 28 of the mounting portion can be folded either way about bend line 32 to a position substantially perpendicular to intermediate portion 14, and tabs 30 can be folded either way about fold lines 36 so as to form hook formations defined by cut-outs 38 and slits 40 for resiliently hooking the mounting portion onto rod 26 either from the front or from behind. Thus, as shown in FIGS. 2 and 5, tabs 38 have been bent back from the central section about lines 36. In this configuration, the tag element is mounted on hook 20 from the front, with circular cut-out 44 being placed over the front end of the hook and the tag element being moved down the hook until central section 28 engages against rod 26. Then, tabs 30 are worked over and around the back of rod 26 and resiliently hooked onto the rod from behind. In this configuration, the tag element can only be attached to the hook when the hook has no products suspended from it.

Figure 3:
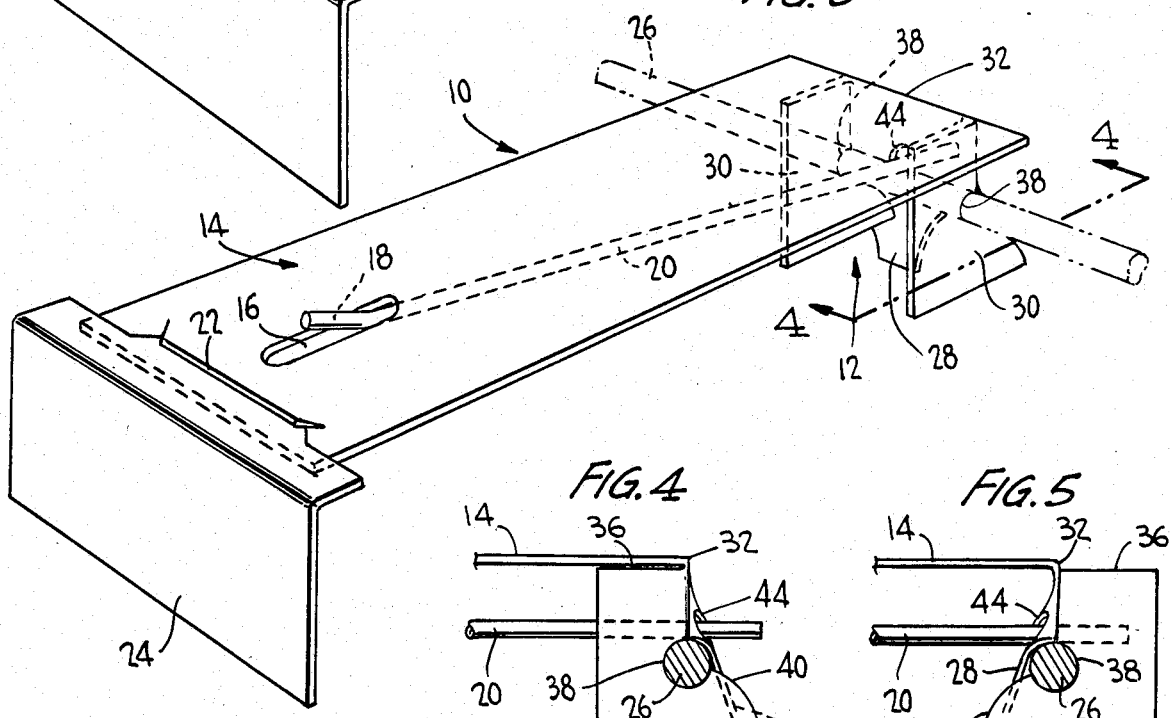
FIG. 3 is a view similar to FIG. 2 showing a second manner of attachment of the tag.
Figure 4:
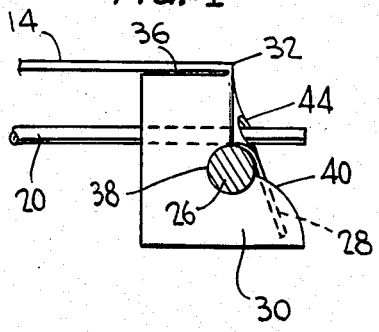
FIG. 4 is a sectional view on line 4—4 of FIG. 3.

In an alternative configuration of the tag element shown in FIGS. 3 and 4, tabs 30 are folded forwardly with respect to central section 28, and the tag element is mounted on hook 20 from the back, with central section 28 engaging the back of rod 26, tabs 30 being worked over the front, and resiliently hooked onto the rod from the front. In this configuration, the tag element can be attached when there are products on the hook. However, the FIG. 2 configuration may be preferable because in the FIG. 3 configuration, for example, when intermediate portion 14 of the tag is lifted to get at a product on the hook, if the back of the hook behind rod 26 is short, cut-out 44 can swing off the rod, whereas this cannot happen with the configuration shown in FIG. 2.

While only a preferred embodiment of the invention has been described herein in detail, the invention is not limited thereby and numerous modifications can be made within the scope of the attached claims.

I claim:

1. A product information and identification tag element of flexible sheet material for use in combination with an assembly comprising an elongate product support hook extending substantially horizontally from a transverse rod at the back of the hook for displaying product information at the front of the hook, the tag element including a mounting portion for attachment to the assembly at a junction of the rod and hook, and an intermediate portion adapted to extend from the mounting portion forwardly over the hook, wherein the mounting portion includes a central section joined to the intermediate portion of the element for folding of the central section to a position substantially perpendicular to the intermediate portion, and tabs on opposite sides of the central section for folding substantially perpendicularly to the central section, the tabs having respective hook formations for resiliently gripping the rod, and the central section having a cut-out for receipt of the hook.

2. The invention of claim 1 wherein the central section can be selectively folded in both directions relative to the intermediate portion and the tabs can be selectively folded in both directions with respect to the central section.

3. The invention of claim 1 wherein the central section is joined to the mounting portion by a transverse bend line, the tabs are joined to the central section by longitudinal fold lines extending from opposite ends of said bend line to respective cut-outs in the mounting portion, and wherein the mounting portion further includes arcuate slits extending from the respective cut-outs to a free transverse edge of the mounting portion, the cut-outs and arcuate slits defining the respective hook formations.

4. The invention of claim 1 in combination with a hook and rod assembly as aforesaid, wherein the tag element is mounted on the assembly from the front of the hook with the central section of the mounting portion engaging against the front of the rod, the tabs being folded rearwardly with respect to the central section, and the hook formations gripping the rod from behind.

5. The invention of claim 1 in combination with a hook and rod assembly as aforesaid, wherein the tag element is mounted on the assembly from the back of the hook with the central section of the mounting portion engaging against the back of the rod, the tabs being folded forwardly with respect to the central section, and the hook formations gripping the rod from the front.

6. The invention of claim 1 wherein the intermediate portion of the tag element has an elongate slot adjacent its forward end for the front end of a hook to project upwardly through.

7. The invention of claim 6 wherein the intermediate portion of the tag element has attachment means at its forward end for a separate display element.

8. A product information and identification tag element of flexible sheet material comprising an elongate portion and a shorter mounting portion at one end of the elongate portion, the mounting portion having a central section connected to the elongate portion by a transverse bend line, and foldable tabs on opposite sides of the central section, the respective tabs being connected to the central section by respective longitudinal fold lines extending from opposite ends of said bend line to respective cut-outs in the mounting portion, the mounting portion further including arcuate slits extending from the respective cut-outs inwardly toward a longitudinal center line of the element and longitudinally to a free transverse edge of the mounting portion, and a further cut-out in the central section of the mounting portion.

* * * * *